US007997751B2

(12) United States Patent
Sisofo

(10) Patent No.: US 7,997,751 B2
(45) Date of Patent: Aug. 16, 2011

(54) PRESSURE-ACTUATED LIGHT DEVICE WITH HOLDING PORTION

(76) Inventor: Steven A. Sisofo, Attamonte Springs, FL (US)

( * ) Notice: Subject to any disclaimer, the term of this patent is extended or adjusted under 35 U.S.C. 154(b) by 298 days.

(21) Appl. No.: 12/329,011

(22) Filed: Dec. 5, 2008

(65) Prior Publication Data

US 2010/0142190 A1 Jun. 10, 2010

(51) Int. Cl.
*F21V 21/08* (2006.01)

(52) U.S. Cl. ..... 362/103; 362/104; 362/189; 362/190; 362/191

(58) Field of Classification Search ..... 362/103, 362/104, 189–191
See application file for complete search history.

(56) References Cited

U.S. PATENT DOCUMENTS 4,012,629 A * 3/1977 Simms ..... 362/104
5,632,548 A 5/1997 Mayfarth
5,653,524 A * 8/1997 Gray ..... 362/104
7,165,859 B1 * 1/2007 Munari ..... 362/103

* cited by examiner

*Primary Examiner* — Stephen F Husar
*Assistant Examiner* — James W Cranson
(74) *Attorney, Agent, or Firm* — The Livingston Firm; Edward M. Livingston, Esq.; Bryan L. Loeffler, Esq.

(57) ABSTRACT

A pressure-actuated light device (1) with a holding portion (2) that allows a user to hold the pressure-actuated light device in a user's hand. The pressure-actuated light device comprises a housing (3) which houses a light emitting diode ("LED") (6) having a cathode (11) and an anode (10) extending from it. The cathode has one end permanently connected to the LED and a second end in constant contact with a negative terminal (8) of a battery (7). The anode has one end permanently connected to the LED and a second end separated from a positive terminal (9) of the battery by a spacer (12) which prevents the anode from making contact with the positive terminal while the device is not in use. When pressure is applied to a button (4) on the housing, the button presses the anode against the positive terminal thereby creating an electrical circuit which activates the LED. The holding portion may take alternative forms, including a fin (13), clip (14), ring (15) or elastomeric loop (16).

6 Claims, 2 Drawing Sheets

PRESSURE-ACTUATED LIGHT DEVICE WITH HOLDING PORTION

BACKGROUND OF THE INVENTION

This invention relates to theatrical lighting devices, more particularly a pressure-actuated light device with a holding portion which will allow a user to easily conceal the device from third parties while in use thereby creating the appearance that light is magically appearing in the users hand and/or from the user's finger tips.

Lighting devices are commonly used for entertainment and theatrical purposes, especially magic shows. For a magic trick to be effective, a magician must use sleight of hand along with specially designed devices to fool audiences into believing the magician is actually using magic to perform the trick. Currently, one device available to magicians is a small flesh-colored imitation thumb tip, usually made of plastic or rubber, which fits loosely over a thumb as described in U.S. Pat. No. 5,632,548, issued as Mayfarth on May 27, 1997. A light may be placed inside the thumb tip at the end of the thumb tip along with a pressure actuator to turn the light on and off. Unfortunately, these devices may be easily spotted by an audience, especially if using the thumb tip while in close proximity to the audience. In addition, these devices are large and clumsy which could cause a magician to make a mistake while performing a trick thereby revealing the thumb tip to an audience.

Thus, a need exists for a pressure-actuated light device with a holding portion which will allow a user to easily conceal the device in the user's hand from third parties while in use.

SUMMARY OF THE INVENTION

The primary object of the present invention is to provide a pressure-actuated light device with a holding portion which will allow a user to easily conceal the device in the user's hand.

Another object of the present invention is to provide a pressure-actuated light device with a holding portion which will allow a user to easily conceal the device from third parties while in use.

A further object of the present invention is to provide a pressure-actuated light device with a holding portion which creates the appearance that light is magically appearing in the users hand and/from the user's fingers.

The present invention fulfills the above and other objects by providing a pressure-actuated light device with holding portion wherein the holding portion is preferably a fin which fits between a users fingers. The fin extends upward from the device and allows the user to hold the pressure-actuated light device at more spots in his/her hand and also allows the user to quickly and to easily conceal the device on his/her person in a place such as a pocket without being seen. The pressure-actuated light device has a housing which houses a lighting means, preferably a light emitting diode ("LED") having a cathode and an anode extending from it. The cathode has one end permanently connected to the LED and a second end in constant contact with a negative terminal of the battery. The anode has one end permanently connected to the LED and a second end separated from a positive terminal of the battery by a spacer which prevents the anode from making contact with the positive terminal while the device is not in use. When pressure is applied to the a button on the base of the housing, the button presses the anode against the positive terminal thereby creating an electrical circuit which activates the LED. The anode and cathode may also be switched so that the anode is in constant contact with the positive terminal and the cathode is separated from the negative terminal by the spacer. The pressure-actuated light device with a holding portion may also be flesh colored to further conceal its presence in a user's hand.

To use the present invention, a user places the fin between his/her fingers and applies pressure to the button of the base of the housing to activate the lighting means. A user may use more than one of the pressure-actuated light device with a holding portion at the same time. For example, a user may hold one pressure-actuated light device with a holding portion in one hand and a second pressure-actuated light device with a holding portion in his/her other hand and alternate activating each pressure-actuated light device thereby creating the appearance that a light is jumping back and forth between the user's hands. Alternative embodiments of the invention include the use of a ring, clip, double sided tape, a book and loop fastener, magnets or elastic as a holding portion.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
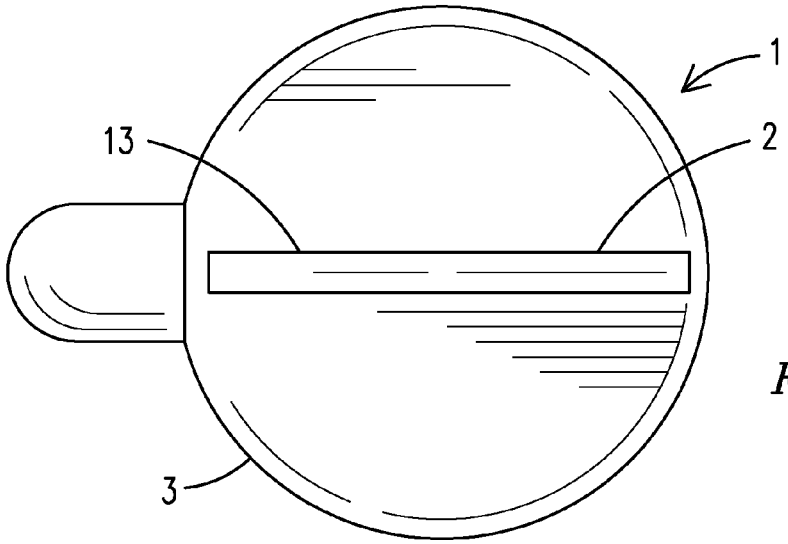
FIG. 1 is a top view of a pressure-actuated light device of the present invention with a fin-like holding portion.
Figure 2:
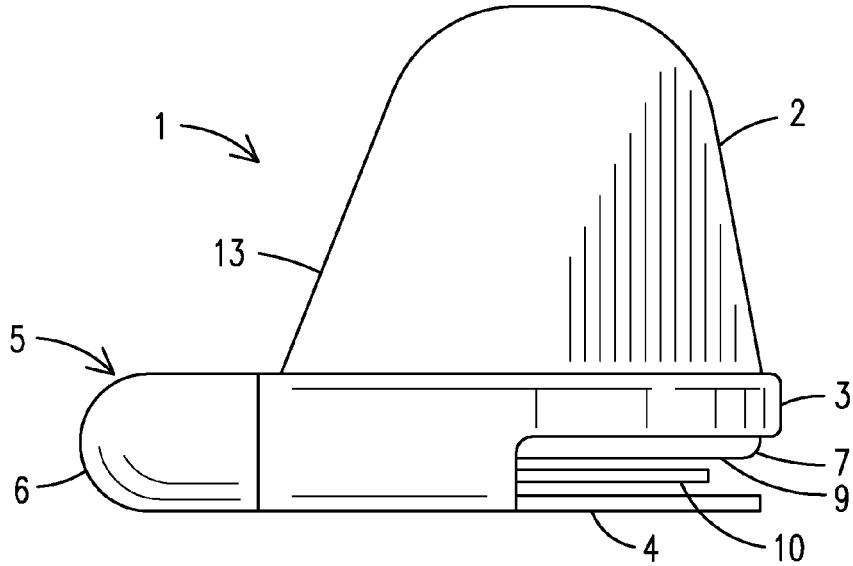
FIG. 2 is a side view of a pressure-actuated light device of FIG. 1.
Figure 3:
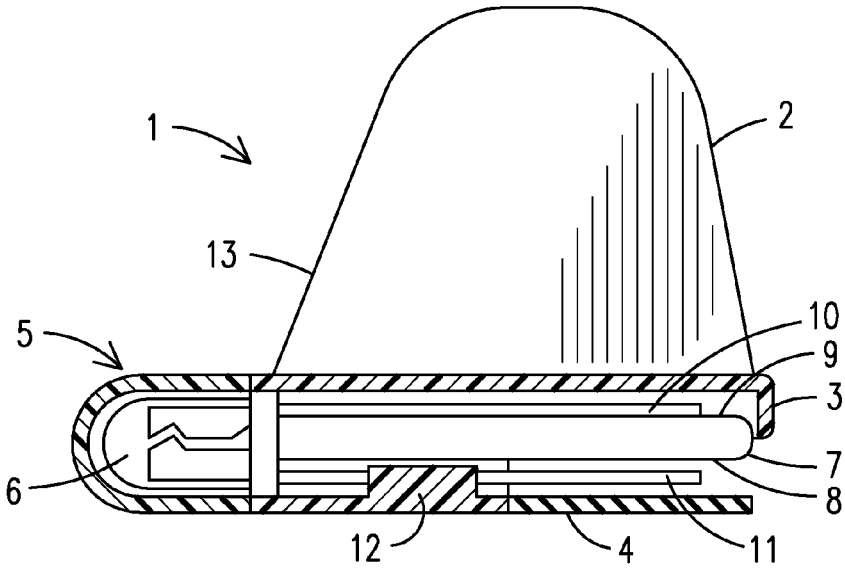
FIG. 3 is a sectional side plan view of a pressure-actuated light device of FIG. 1.

For purposes of describing the preferred embodiment, the terminology used in reference to the numbered components in the drawings is as follows:

1. pressure-actuated light device
2. holding portion
3. housing
4. activation button
5. lighting portion
6. light emitting diode ("LED")
7. battery
8. negative terminal
9. positive terminal
10. anode
11. cathode
12. spacer
13. fin -continued 14. clip
15. ring
16. elastomeric loop Referring now to the drawing figures, FIGS. 1, 2 and 3 depict a pressure-actuated light device of the present invention 1 with a holding portion 2 that is a fin 13. The pressure-actuated light device 1 comprises a housing 3 the holding portion 2 affixed to the top of the housing 3 which extends upward. The holding portion is preferably a fin 13 which may be placed between a user's fingers and used to hold the pressure-actuated light device 1.

Referring to FIG. 2, a side view of a pressure-actuated light device of FIG. 1, the lighting means 5 of the device is shown as a light emitting diode ("LED") 6 having a cathode and an anode 10 extending from it. The anode 10 has one end permanently connected to the LED 6 and a second end separated from a positive terminal 9 of the battery 7 by a spacer which prevents the anode 10 from making contact with the positive terminal 9 while the pressure-actuated light device 1 is not in use. When pressure is applied to the a activation button 4 of the housing 3, the activation button 4 presses the anode 10 against the positive terminal 9 thereby creating an electrical circuit which activates the LED 6. The anode 10 and cathode may also be switched so that the anode 10 is in constant contact with the positive terminal and the cathode 11 is separated from the negative terminal 8 by the spacer 12 as shown in FIG. 3.

Referring to FIG. 3, a sectional side plan view of a pressure-actuated light device of the present invention 1 with a holding portion 2 is shown. The pressure-actuated light device 1 comprises a housing 3 having an activation button 4 which may be made from a flexible material such as rubber which would allow a user to apply pressure thereby pushing the activation button 4 upward. The holding portion 2 is preferably a fin 13 which extends upward form the housing 3 and may be placed between a user's fingers. The housing 3 houses a lighting means 5, which is shown as a light emitting diode ("LED") 6 having a cathode 11 and an anode 10 extending from it. The anode 10 has one end permanently connected to the LED 6 and a second end in constant contact with a positive terminal 9 of a battery 7. The cathode 11 has one end permanently connected to the LED 6 and a second end separated from a negative terminal 8 of the battery 7 by a spacer 12 which prevents the cathode 11 from making contact with the negative terminal 8 while the pressure-actuated light device 1 is not in use. When pressure is applied to the activation button 4 of the housing 3, the activation button 4 presses the cathode 11 against the negative terminal 8 thereby creating an electrical circuit which activates the LED 6.

Figure 4:
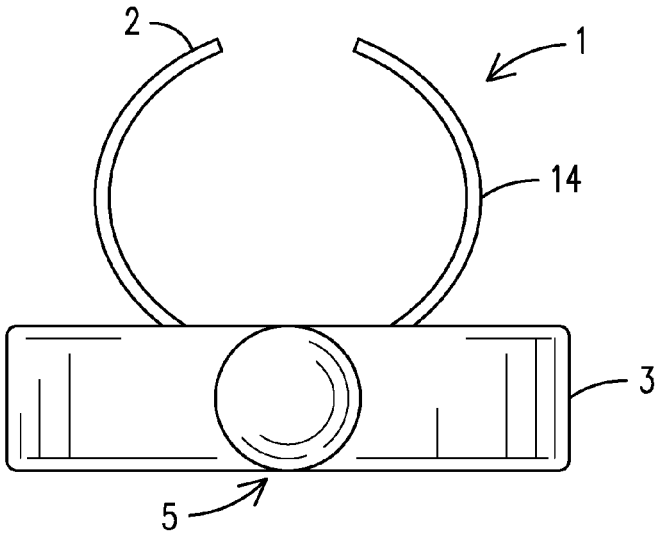
FIG. 4 is a front view of a pressure-actuated light device of the present invention wherein a holding portion comprises a clip.

Referring to FIG. 4, a front view of a pressure-actuated light device of the present invention wherein the holding portion 2 comprises a clip 14 is shown. The clip 14 may be placed around a user's finger hold the pressure-actuated light device 1 preferably on the inside of a user's hand.

Figure 5:
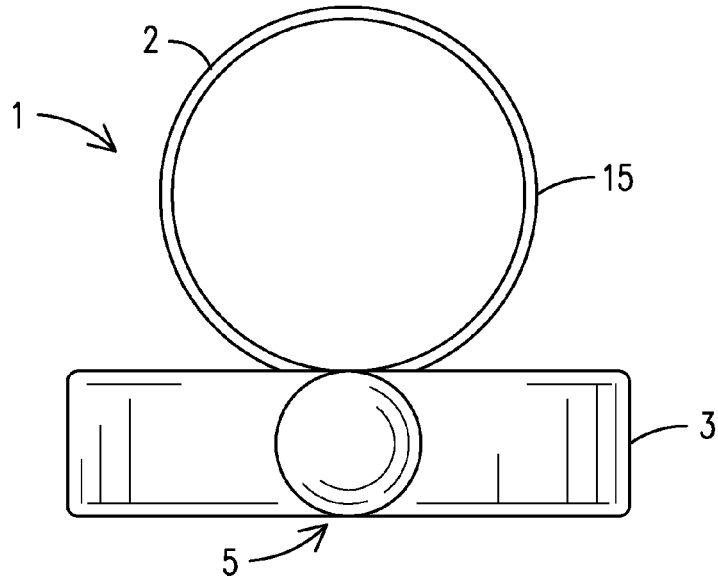
FIG. 5 is a front view of a pressure-actuated light device of the present invention wherein a holding portion comprises a ring.

Referring to FIG. 5, a front view of a pressure-actuated light device of the present invention wherein the holding portion 2 comprises a ring 15 is shown. The ring 15 may be placed around a user's finger to hold the pressure-actuated light device 1 preferably on the inside of a user's hand.

Figure 6:
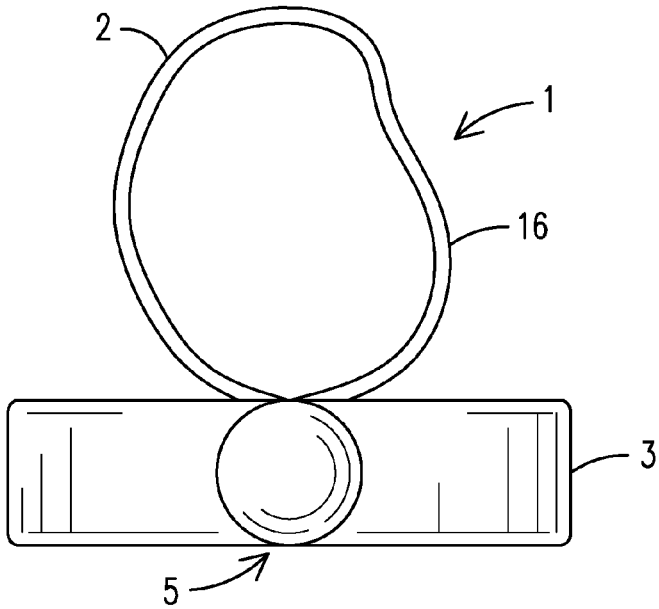
FIG. 6 is a front view of a pressure-actuated light device of the present invention wherein a holding portion comprises an elastomeric loop.

Referring to FIG. 6, a front view of a pressure-actuated light device of the present invention wherein the holding portion 2 comprises an elastomeric loop 16 is shown. The elastomeric loop 16 may be placed around a user's finger and used to hold the pressure-actuated light device 1 preferably on the inside of a user's hand.

Although a preferred embodiment of a pressure-actuated light device with a holding portion has been disclosed, it should be understood, it is not to be limited to the specific form or arrangement of parts herein described and shown. It will be apparent to those skilled in the art that various changes may be made without departing from the scope of the invention and the invention is not be considered limited to what is shown and described in the specification and drawings.

Having thus described my invention, I claim:

1. A pressure-actuated light device comprising:
a housing having an upper surface and a lower surface;
a single rigid fin extending outward from the upper surface that allows a user to hold the fin between the user's fingers;
a lighting means affixed to said housing for producing light;
a battery in said housing for powering said lighting means;
a cathode connecting said lighting means to a negative terminal of said battery;
an anode for connecting said lighting means to a positive terminal of said battery; and
a button located on the lower surface of said housing for activating said lighting means.

2. The pressure-actuated light device of claim 1 wherein:
said cathode is in constant contact with the negative terminal of said battery; and
said anode is partially separated from the positive terminal of said battery by a spacer which prevents the anode from making contact with the positive terminal while the device is not in use.

3. The pressure-actuated light device of claim 1 wherein:
said anode is in constant contact with the positive terminal of said battery; and
said cathode is partially separated from the negative terminal of said battery by a spacer which prevents the anode from making contact with the positive terminal while the device is not in use.

4. The pressure-actuated light device of claim 1 wherein:
said lighting means is a light emitting diode.

5. The pressure-actuated light device of claim 1 wherein:
said button is partially attached to the housing thereby allowing the rear of the button to be pressed upward.

6. The pressure-actuated light device of claim 1 wherein:
said button is made of rubber thereby allowing the button to be pressed upward.

* * * * *